United States Patent [19]

Cappel et al.

[11] 3,978,788

[45] Sept. 7, 1976

[54] INK METERING ASSEMBLY FOR PRINTING PRESS

[75] Inventors: Bert Cappel, Offenbach-Bieber; Siegfried Schuhmann, Offenbach; Klaus Wolf, Neu-Isenburg, all of Germany

[73] Assignee: Roland Offsetmaschinenfabrik Faber & Schleicher AG, Germany

[22] Filed: May 16, 1975

[21] Appl. No.: 578,039

[52] U.S. Cl. ..... 101/363; 101/365

[51] Int. Cl.[2] ..... B41F 31/02

[58] Field of Search ..... 101/364, 365, 363, 208, 101/210, 350, 157, 169

[56] References Cited

UNITED STATES PATENTS

| | | | |
|---|---|---|---|
| 1,778,476 | 10/1930 | Wood | 101/365 |
| 2,161,943 | 6/1939 | Baue | 101/365 |
| 2,583,640 | 1/1952 | Faebier | 101/365 |
| 2,837,024 | 6/1958 | Dougan | 101/365 |
| 3,120,802 | 12/1964 | Smejda | 101/157 |
| 3,236,178 | 2/1966 | Worthington et al. | 101/365 |
| 3,699,888 | 10/1972 | Easoz | 101/365 |
| 3,855,927 | 12/1974 | Simeth | 101/365 X |
| 3,895,575 | 7/1975 | Cappel et al. | 101/365 X |
| 3,913,479 | 10/1975 | Cappel et al. | 101/365 |

*Primary Examiner*—Edgar S. Burr
*Assistant Examiner*—Paul J. Hirsch
*Attorney, Agent, or Firm*—Leydig, Voit, Osann, Mayer & Holt, Ltd.

[57] ABSTRACT

An ink fountain having a metering assembly in the form of a series of rectangularly shaped slides fitted into a horizontal slot in a frame with only the presented front ends of the slides being exposed and abutting the fountain roller. The slides are arranged side by side in coplanar relation with their lateral edges lying closely adjacent one another. Notches are formed in the lateral edges of the slides adjacent the front ends thereof, with the notches being occupied by slightly oversized buttons of resilient sealing material. The metering assembly is held captive at its ends between two vertical end plates which apply inward squeezing pressure to the metering assembly so as to compress the resilient buttons uniformly to bring the lateral edges of the slides into snug sliding relation to prevent leakage of ink between them and for the purpose of distributing any cumulative tolerance error equally between all of the slides in the series. Means are provided for confining the rear ends of the slides so that all the slides of the series are oriented precisely parallel to one another. Each of the slides has provision at its rear end for longitudinal adjustment in the form of an eccentric mechanism having a shallow throw. Each of the slides has a shank portion which is laterally relieved over the major portion of the length thereof so that the lateral edges of adjacent slides are in engagement only at the front and rear ends.

9 Claims, 4 Drawing Figures

INK METERING ASSEMBLY FOR PRINTING PRESS

In a common type of ink fountain the thickness of the ink formed on the fountain roller is determined by the adjustment of a thin flexible fountain blade having adjusting screws at intervals therealong to determine the clearance between the edge of the blade and surface of the roller thereby to adjust the thickness of the ink to the ink requirements of the plate in the respective column positions. One of the problems with such an ink adjusting arrangement is that the edge of the blade is continuous so that variations in ink feed from point to point along the edge of the blade can vary only gradually and not in a stepped fashion required by adjacent columns of the printed material. Moreover the turning of each adjusting screw tends to affect the adjustment of ink film in the adjacent column positions.

Thus it has been recognized for a long time that instead of using a continuous flexing blade a sectioned metering bar should be employed capable of stepped adjustment between adjacent sections.

In our copending applications Ser. Nos. 371,594 and 551,630 sectioned metering bars are disclosed in which the front ends are interconnected by a continuous layer of tough resilient plastic material to permit limited relative adjustment of adjacent sections and to preclude leakage of ink between the sections. In the past it has not been practical to make the sections in the form of completely independent and individually adjustable slides because of the difficulty of maintaining close enough width tolerances of the slides to provide an assembly or bar of predetermined length while precluding leakage between the slides by reason of accumulated error.

It is accordingly an object of the present invention to provide a metering assembly consisting of a plurality of completely independent slides arranged laterally edge to edge, filling the entire space between confining end plates and in which resilient means are provided between adjacent slides to take up any error in width dimension and to preclude leakage by reason of the cumulative error in width dimension throughout the series. It is a more specific object of the present invention to provide a metering assembly consisting of slides of rectangular shape and having parallel upper and lower surfaces in which the lateral edges of the slides are notched adjacent the front ends thereof, the notches being occupied by slightly oversized buttons of resilient sealing material so that when squeezing force is applied to the ends of the assembly by the end plates the slides are all spaced apart to equal degree and squeezed into snug edge to edge sliding relationship with any cumulative error in width dimension equalized throughout the series so that leakage between adjacent slides cannot occur.

It is still another object of the present invention to provide means for guiding and clamping the rear ends of the slides as well as the front ends so that the slides are all preserved in perfectly parallel relation with no possibility of skewing of individual slides.

It is yet another object of the present invention to provide a metering assembly for an ink fountain consisting of a series of slides arranged laterally edge to edge which are independent from one another and independently adjustable but in which the presented front ends of the series of slides forms a metering edge which is substantially continuous but permits stepped adjustment in accordance with the ink requirements in the respective column positions.

Other objects and advantages of the invention will become apparent upon reading the attached detailed description and upon reference of the drawings in which.

While the invention has been described in connection with a preferred embodiment, it will be understood that we do not intend to be limited to the particular embodiment shown but intend, on the contrary, to cover the various alternative and equivalent forms of the invention included within the spirit and scope of the appended claims.

Figure 1:
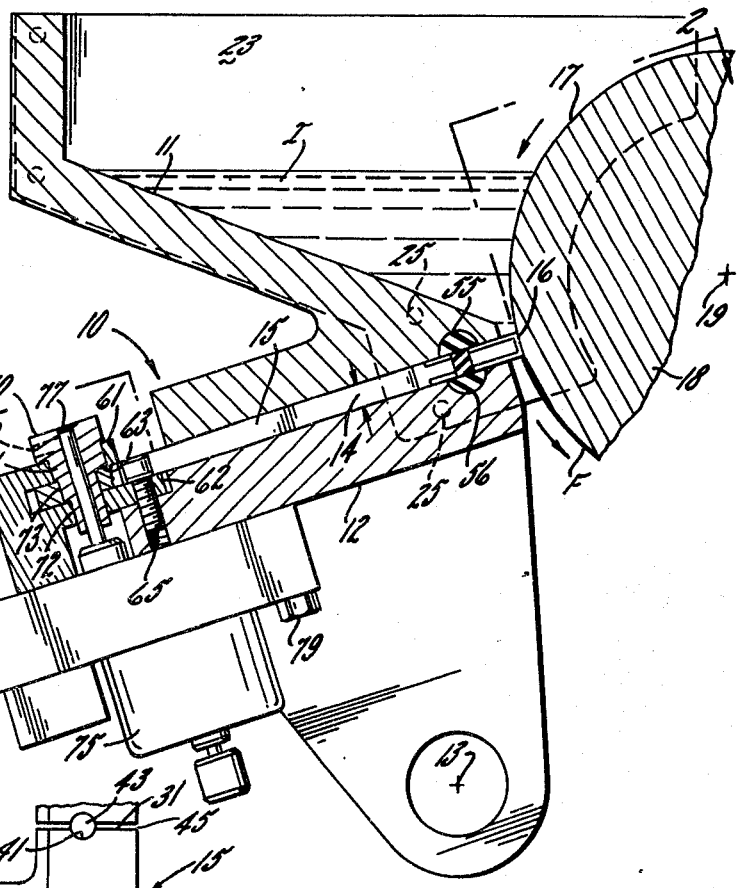
FIG. 1 is a vertical section taken through an ink fountain embodying the present invention looking along the line 1—1 in FIG. 2.

Turning now to FIG. 1 there is shown an ink fountain having a frame 10 which includes an upper trough portion 11 and a lower or base portion 12. The portions are hinged together for relative movement about a hinge axis 13. The two portions, together, define a horizontal slot 14. Fitted snugly in the slot is a metering assembly 15 having a presented front edge 16 which abuts against the surface 17 of a fountain roller 18, the plane of the metering assembly preferably falling close to the axis 19 of the roller.

Figure 2:
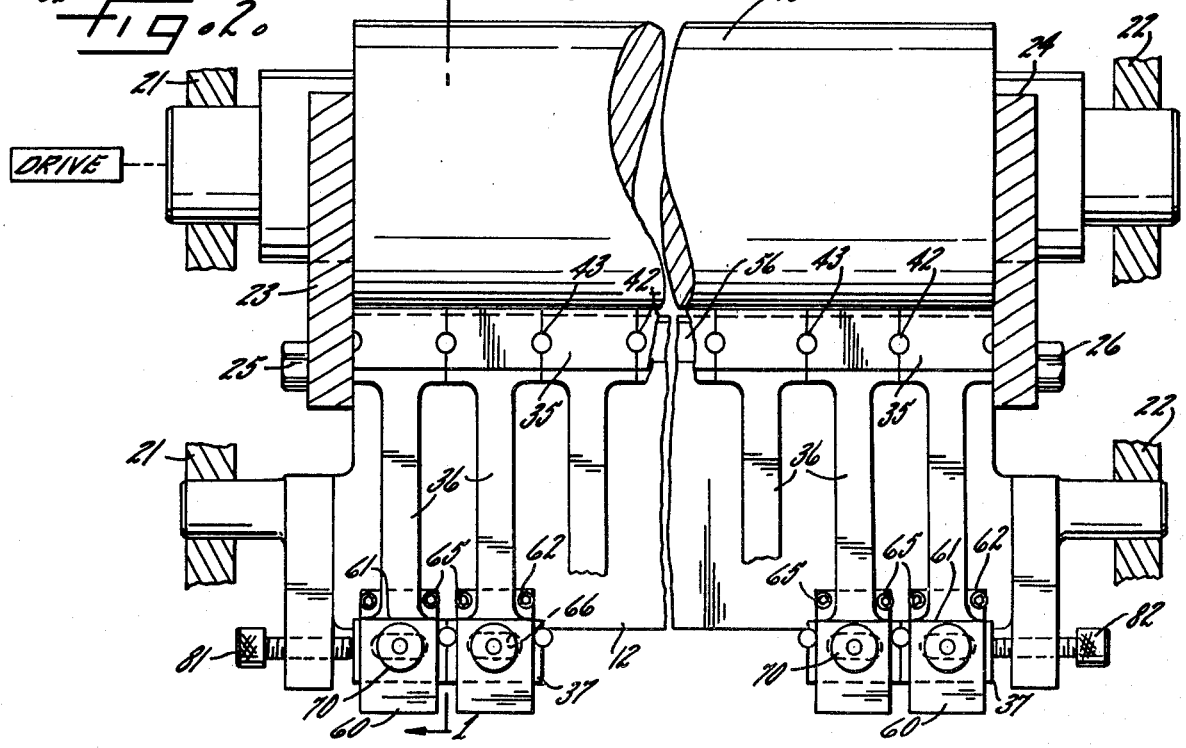
FIG. 2 is a fragmentary plan view of the metering assembly looking along the line 2—2 in FIG. 1 showing slides defining zones of adjustment.

The ends of the fountain roller are journalled for rotation in end members 21, 22 of the frame which are shown fragmentarily in FIG. 2. Spaced inwardly from the members 21, 22 are end plates 23, 24 secured by screws 25, 26. The end plates, which are shown in profile in FIG. 1, bear against the respective ends of the metering assembly 15 as well as against the ends of the fountain roller and the ends of upper and lower members 11, 12 to enclose a trough which carries a body of ink I. When the fountain roller is rotated in the direction shown so that the surface 17 passes downwardly through the body of ink, a film of ink F is established on the fountain roller, the thickness of which depends upon the clearance between the metering assembly and the roller surface.

In accordance with the present invention the metering assembly 15 is in the form of a series of rectangularly shaped slides arranged side-by-side in coplanar relation with their lateral edges lying closely adjacent one another, the adjacent slides being notched along the lateral edges adjacent the front ends thereof, the notches being occupied by slightly oversized buttons of resilient sealing material and with the series of slides being compressed inwardly by the end plates so that all of the buttons of sealing material are compressed to equal degree bringing the lateral edges into snug sliding engagement and distributing dimensional error in the width dimension of the slides equally between the slides so as to preclude leakage between any two adjacent slides in the series.

Figure 4:
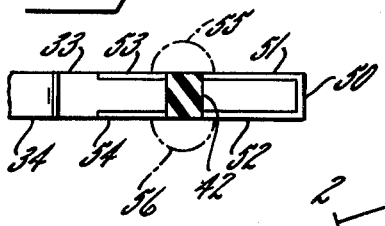
FIG. 4 is a fragmentary section taken along line 4—4 in FIG. 3.
Figure 3:
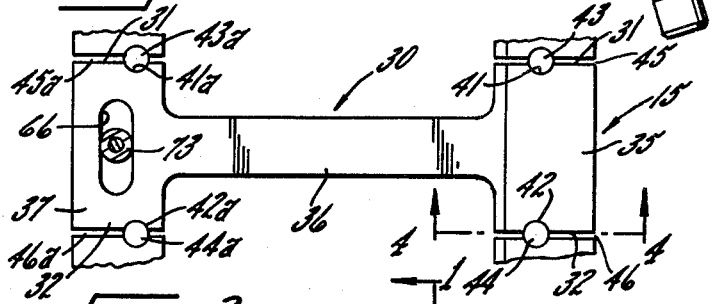
FIG. 3 shows in plan view a single slide and portions of adjacent slides with the resilient sealing buttons in the unstressed state and before endwise pressure is applied.

Taking one of the slides 30 as typical, and as set forth in FIG. 3, the slide has lateral edges 31, 32 which are parallel to one another and top and bottom surfaces 33, 34 (see FIG. 4) which are, likewise, parallel to one another. The slide has a front end 35, a central or shank portion 36, and a rear end 37. The shank portion 36 is preferably cut out, or relieved, over the major length of the slide so that the lateral edges 31, 32 are in engagement with the adjacent slides only at the respective ends of the slide. Each slide is, in short, of slightly "dumbbell" profile.

The slide 30, in carrying out the invention, has lateral notches 41, 42 intersecting the lateral edges 31, 32, the notches being occupied by slightly oversized buttons 43, 44 of resilient sealing material. Such buttons may be formed of a plastic having stable resilient characteristics as for example:

The buttons 43, 44 preferably have a diameter, in the relaxed state, which is sufficient to spread apart the adjacent slides creating between them gaps indicated at 45, 46 which may be on the order of 0.010 inch to 0.020 inch.

In the preferred embodiment of the invention the rear ends of the slide 30 are similarly treated, being formed with notches **41*a*, 42*a*, occupied by resilient buttons 43*a*, 44*a* to create similar gaps 45*a*, 46*a***.

In addition to the resilient buttons, each slide is equipped with a covering layer 50 of resilient material which is "wrapped" over the top surface of the slide as indicated at 51 and wrapped under the bottom surface of the slide as indicated at 52, the slide being undercut top and bottom as indicated at 53, 54 to a degree equal to the thickness of the layer and so that the top and bottom surfaces of the slide are parallel and smoothly continuous from one end to the other. In addition, for the purpose of preventing leakage of ink along the upper and lower surfaces, the parallel walls of the frame members are longitudinally relieved to form opposed grooves which are occupied by strips of resilient sealing material 55, 56. The latter, by reason of continuity, form a bridge, for sealing purposes, between the adjacent slides.

In carrying out the invention, each slide is not only independent from all of the other slides but has individual means for adjustment. To this end, each of the slides is supported at its rear end upon a bracket, or bearing housing, 60, having parallel portions 61, 62 which define, between them, a slot 63 in which the rear end of the slide is snugly slidable. The bracket is secured to the base portion 12 of the frame by means of screws 65. For determining the endwise position of the slide, each slide has a transverse slot 66 formed in its rear end, engaged by a rotatable bushing 70. The bushing has upper and lower bearing portions 71, 72 which are coaxially fitted in portions in the opposed portions 61, 62 of the bracket, as well as an eccentric portion 73 which mates with the slot 66. The bushing is rotated by a motor 75 having a gearbox 76 with an output shaft 77 to which the bushing is secured by a set screw 78. The gearbox and motor are secured to the base portion of the frame by screws 79.

For clamping the rear ends of the slides snugly edge-to-edge, a pair of clamping screws 81, 82 are provided, arranged coaxially and in opposed relation. When the screws 25, 26 which secure the end plates 23, 24 are tightened, thereby bringing the end plates snugly up against the ends of the fountain roller, inward squeezing force is at the same time applied edgewise at the front ends of the slides which form the metering assembly, compressing all of the resilient buttons to equal degree and causing the same amount of space to exist between the engaged edges, adjacent the slides. When the endplates 23, 24 have been brought into fully seated position, the gaps 45, 46, (FIG. 3) have closed so that the lateral surfaces of the slides are in substantial sliding engagement and are, in any event, so closely spaced as to preclude leakage of ink between them. Thus, in the event that there is dimensional error in the width dimensions of the slides, which may occur within normal matching tolerances, the dimensional error will be distributed equally between the slides throughout the series and the error cannot accumulate to show up as a gap between two adjacent slides with resultant leakage.

In order that the rear ends of the slides may be brought together to the same degree to keep the sides perfectly parallel to one another, the clamping screws 81, 82 are advanced to apply equal pressure to the rear end of the metering assembly.

While it is true that adjacent ones of the slides are keyed together by the effect of the notches and buttons which are between them, nevertheless each of the buttons is susceptible to deformation, in shear, so that the longitudinal position of one slide, relative to its neighbor, may differ by as much as 0.010 inch. To insure differential stepped adjustment over this range using only low power motor drives, each of the buttons, in a practical case, preferably has a diameter of 6 mm. and a thickness of 7 mm. and is made of resilient plastic, as above, having a durometer rating on the order of 16 shore.

It will be seen then that the present metering adjustment has all of the advantages of a continuous, though sectioned, metering bar disclosed in the above mentioned applications with the further advantage that each of the slides is perfectly independent and subject to individual adjustment to obtain a more precise stepped adjustment than has been possible heretofore. While the sections are close enough to preclude leakage of ink between any two of them, the individual slides may be manufactured at low cost employing only normal machining tolerances. Moreover, because of their individual nature and mounting, assembly and disassembly for cleaning and periodic maintenance is easy and down time is minimized.

Only a very narrow tip portion of each slide is exposed so that there is little or no accumulation of dry or gummy ink. Because of the positive push-pull operation of the eccentric adjusting means, combined with the high degree of mechanical advantage of the shallow eccentric, precise and reproducible settings may be achieved using only low power motor drives.

What is claimed is:

1. In an ink fountain the combination comprising a frame defining a horizontal slot having parallel walls, a fountain roller rotatable in the frame adjacent the slot, a metering assembly mounted in the slot and having a presented front edge arranged in abutting relation with the surface of the roller, the frame being shaped to support a body of ink adjacent the metering assembly so that a film of ink is formed on the roller by the assembly as the roller is rotated, the metering assembly being in the form of a series of rectangularly shaped slides arranged side by side in coplanar relation with their laterial edges lying closely adjacent one another so that the presented front edge is substantially continuous, the lateral edges of the slides adjacent the front ends thereof being formed with registering notches of uniform size, the registering notches being occupied by slightly oversized buttons of resilient sealing material, the resilience of the oversized buttons tending to spread the slides slightly away from one another to establish uniform spacing between them, vertical end plates at the respective ends of the assembly for clamping the slides together with the buttons of resilient material in compression with the lateral edges of the slides in free relatively sliding relation and so closely spaced as to seal the assembly against leakage of ink, and cam assemblies at the rear ends of the slides for individually adjusting the position of each slide with respect to the fountain roller thereby to meter ink in predetermined thickness in respective zones upon the fountain roller.

2. The combination as claimed in claim 1 in which each of the slides has a front portion, shank portion and rear portion and in which the shank portions are laterally relieved over the major portion of the length of the slide so that the lateral edges of the slides are only in edge to edge engagement at the front of the slide and at the rear of the slide.

3. The combination as claimed in claim 1 in which the lateral edges of the slides have notches formed therein adjacent the rear ends and in which the notches are occupied by slightly oversized buttons of resilient sealing material similarly to the buttons adjacent the front ends of the slides.

4. The combination as claimed in claim 1 in which the presented front ends of the slides are coated to a constant thickness with a layer of tough resilient material.

5. The combination as claimed in claim 4 in which the tough resilient material is extended in parallel layers along the top surface and under surface of each of the slides.

6. The combination as claimed in claim 5 in which the upper and lower surfaces at the front end of each slide are relieved by an amount equal to the thickness of the plastic layers thereon so that the upper and lower surfaces of each plastic coated slide are smooth and continuous from one end of the slide to the other.

7. The combination as claimed in claim 3 in which adjustable means are provided at each end of the metering assembly, and opposite the rear ends of the slides, for applying inwardly directed force for overcoming the resilience of the buttons at the rear ends of the slides for forcing the rear ends together so that the slides are maintained parallel throughout the series.

8. The combination as claimed in claim 7 in which the clamping means is in the form of a pair of clamping screws threaded into the frame in opposed coaxial relationship.

9. The combination as claimed in claim 1 in which the buttons are cylindrical and in which the notches are semi-circular in profile, the radius of the buttons slightly exceeding the radius of the notches, with the buttons being subject to shearing stress along the diameter upon differential adjustment of adjacent slides.

* * * * *